United States Patent [19]

Bacher

[11] 4,214,837

[45] Jul. 29, 1980

[54] DISC PRINTERS

[75] Inventor: Eric Bacher, Yverdon, Switzerland

[73] Assignee: Hermes Precisa International S.A., Yverdon, Switzerland

[21] Appl. No.: 931,268

[22] Filed: Aug. 4, 1978

Related U.S. Application Data

[63] Continuation of Ser. No. 803,942, Jun. 6, 1977, abandoned, which is a continuation of Ser. No. 619,826, Oct. 6, 1975, abandoned.

[30] Foreign Application Priority Data

Oct. 16, 1974 [CH] Switzerland ..... 13848/74

[51] Int. Cl.[2] ..... B41J 1/32

[52] U.S. Cl. ..... 400/144.3; 400/157.3; 101/93.19

[58] Field of Search ..... 400/144.3, 144.2, 144.1, 400/144, 157.3; 101/93.15, 93.19

[56] References Cited

U.S. PATENT DOCUMENTS

| | | | |
|---|---|---|---|
| 3,574,326 | 4/1971 | Koehn | 400/144.3 |
| 3,651,916 | 3/1972 | Becchi | 101/93.19 X |
| 3,701,104 | 10/1972 | Wiseman | 364/900 |
| 3,707,214 | 12/1972 | Ponzano | 400/144.2 |
| 3,712,212 | 1/1973 | Berry | 101/93.19 |
| 3,731,780 | 5/1973 | Wolf et al. | 101/93.19 X |
| 3,858,509 | 1/1975 | Grundherr | 101/93.19 |
| 3,901,371 | 8/1975 | Scott, Jr. | 101/93.19 X |
| 3,946,852 | 3/1976 | Watson et al. | 400/144.3 |
| 3,949,853 | 4/1976 | Lahr | 400/174 |
| 3,954,163 | 5/1976 | Gabor | 101/93.19 |
| 4,118,129 | 10/1978 | Grundherr | 400/157.3 |

FOREIGN PATENT DOCUMENTS

| | | | |
|---|---|---|---|
| 2000783 | 7/1971 | Fed. Rep. of Germany | 400/144.3 |
| 2111398 | 9/1971 | Fed. Rep. of Germany | 400/144.3 |

OTHER PUBLICATIONS

"Variable Pitch Print Wheel", IBM Tech. Discl. Bulletin, vol. 16, No. 10, Mar. 1974, pp. 3221-3222.

"Character Impression Control Mechanism", IBM Tech. Discl. Bulletin, vol. 1, No. 4, Dec. 1958, p. 44.

"Character Wheel For Low Cost Changeable Font Printer", IBM Tech. Discl. Bulletin, Branson et al., vol. 16, No. 5, Oct. 1973, p. 1515.

"Arrangement for Encoding the Impact Energy", XE Discl. Journal, Sohl, vol. 1, No. 9/10, Sep./Oct. 1976, p. 25.

*Primary Examiner*—E. H. Eickholt

*Attorney, Agent, or Firm*—Emory L. Groff, Jr.

[57] ABSTRACT

The type carrying disc has the type characters spaced irregularly along the disc periphery in dependence on their width, but the order in which these characters appear on the disc is independent of their width. Associated on the disc with each type character is an aperture that indicates the angular position of the corresponding type character. A photoelectric detector reads these apertures as the disc spins, and enables, in dependence on a coded signal, the disc to be stopped at the correct position for printing the desired character. In other embodiments, the aperture or other means indicates one or another printing characteristic, such as printing force or size of the printing step.

13 Claims, 8 Drawing Figures

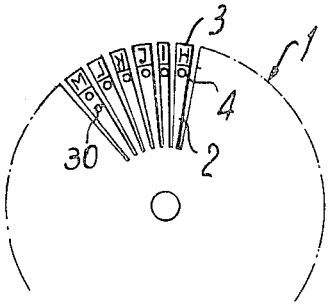
FIG. 1
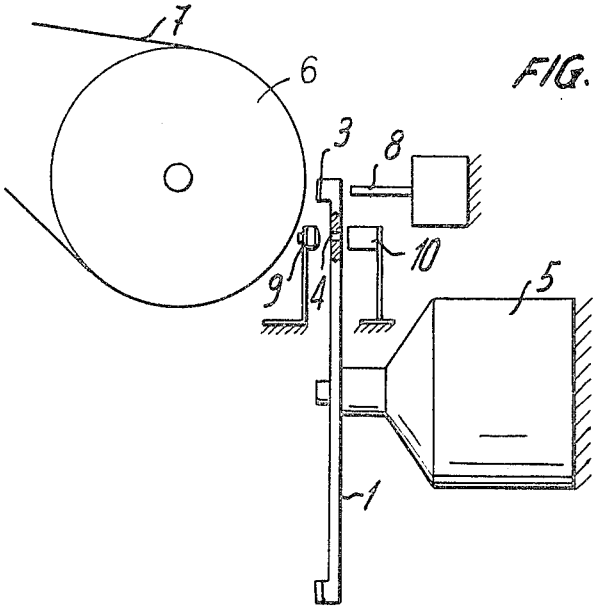
FIG. 2
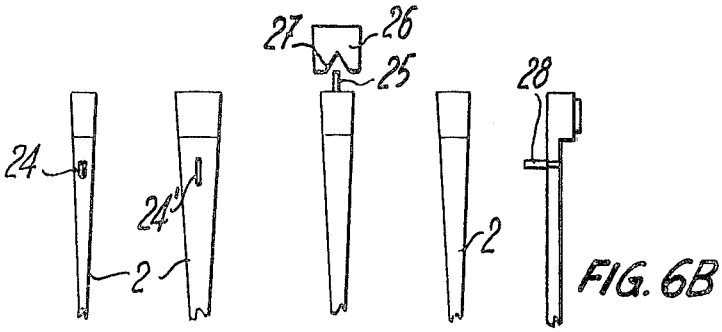
FIG. 6B
FIG. 4A FIG. 4B FIG. 5 FIG. 6A

DISC PRINTERS

This is a continuation of Application Ser. No. 803,942 filed June 6, 1977 which is a continuation of Ser. No. 619,826, filed Oct. 6, 1975 both of which are now abandoned.

The invention relates to improvements in disc printers, which printers comprise a rotatable support having the type characters in relief, the characters being brought to a position opposite the printing surface, where the character in the printing position is struck by a hammer to print on the printing surface.

In known printers of this kind, the type characters are carried by the flexible radial arms of a rotatable support in the form of a disc or cone. These arms occur at a constant angular spacing, so that the type characters are uniformly spaced along a circumference. Consequently, the type character that is to be printed is selected by a number of constant angular steps. Since the rotatable support is usually made of a molded synthetic plastic, it is difficult to obtain a highly precise angular position of each type character, because the internal mechanical stresses distort the support after it is removed from the mold.

Moreover, the observance of a constant angular step between type characters means that the size of this step depends on the widest type character, which fact results in a rotatable support that is undesirably large and therefore heavy. With a view to obtaining higher printing speeds, it has been sought to reduce the diameter and the inertia of the rotatable support by alternating the wide and narrow type characters. This leads to special orders in which the type characters appear on the support, none of which orders corresponds to those of the codes of the American Standard Code for Information Interchange (ASCII), which are widely used in information interchange. This lack of correspondence complicates the electronic circuits that control the rotation of the support.

An object of the invention is improvements in disc printers, which improvements remedy the aforesaid faults.

In accordance with the invention, this object is attained by irregularly spacing the type characters about the rotational axis of the support so that the angular arc occupied by each type character is dependent on the width thereof, indicating means incorporated by the support for indicating the angular position of each type character, and reading means for reading the indicating means, and for providing from the reading, a signal for controlling the printing of each character so as to obtain a uniform distribution of the printed characters on the printed copy.

BRIEF DESCRIPTION OF THE DRAWINGS

FIG. 1 is a front view of part of the rotatable support.

FIG. 2 is a side view, partly cut away, of the mechanical form of one embodiment.

FIG. 4A shows a radial arm of a first modification of the invention.

FIG. 4B shows a second radial arm constituting a portion of the first modification.

FIG. 5 shows a radial arm and adjacent control structure constituting a second modification of the invention.

FIG. 6A shows a radial arm constituting a third modification of the invention.

FIG. 6B shows a side view of the radial arm of FIG. 6A.

FIG. 1 shows a rotatable support 1 consisting of a synthetic plastic disc composed of flexible radial arms 2, each arm incorporating at its free end a type character 3 in relief. Each arm also has an aperture 4, the angular position of which about the axis of rotation of the disc 1 is very precisely located with respect to the angular position of the associated type character 3.

As shown in FIG. 2, the disc 1 is mounted on the shaft of a servo motor 5, so that each type character 3 can be moved to a position opposite a cylinder 6, over which passes a sheet of paper 7. This sheet constitutes the printing surface. The means for guiding the sheet over the cylinder 6, as well as those that control the rotation of this cylinder, are not shown, because they are well known in themselves and do not form a part of the invention.

Figure 3:
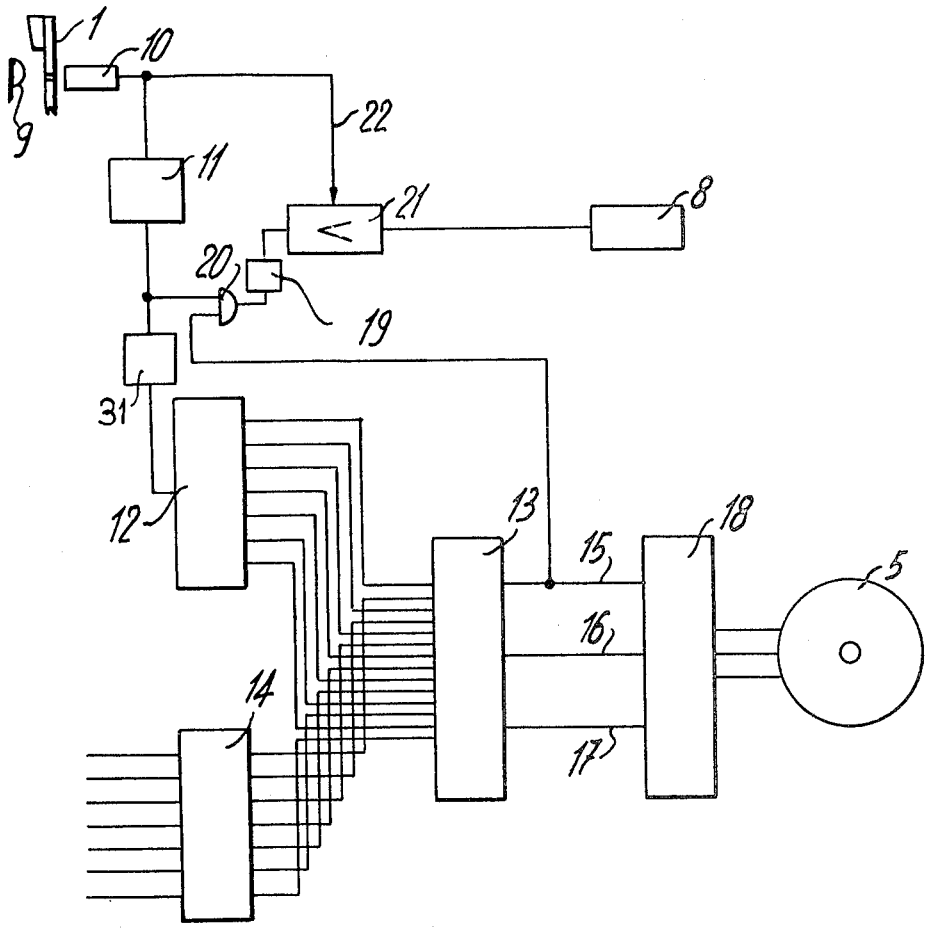
FIG. 3 is a block diagram of the electrical circuitry for controlling the rotation of the support.

To cause the printing of the desired character, the motor 5 is rotated until the character is positioned opposite the sheet 7. After the disc 1 is stopped, an electromagnetically driven hammer 8 is operated to strike the character 3 against the paper 7. The arm 2 is free to move because it is flexible.

In order to ensure that the motor 5 stops at the precise position, the printer incorporates a photoelectric arrangement for determining the correct position of the character to be printed. This arrangement includes a light source 9 placed on one side of the disc 1. When the arm 2 is correctly positioned, the light beam from the source 9 passes through the aperture 4 and falls on a photoelectric detector 10. Moreover, one of the arms 2 of the disc 1 also has an aperture 30 that is closer to the center of the disc, and which enables, by means of a second photodetector (not shown), to fix a predetermined angular position of the disc, if necessary.

The control for the servo motor 5 is shown in FIG. 3, which also shows the light source 9 and the photodetector 10. The detector 10 receives the light beam through the aperture 4 each time that an arm 2 passes before it. The beam also falls on the detector each time that a radial slit separating two consecutive arms 2 moves past the photo-detector. Consequently, the latter furnishes electrical pulses that are shaped by a trigger 11. The pulse output of the trigger, after passing through a divide by two circuit 31, goes to a counter 12, the outputs of which are connected to a comparator 13. This comparator also receives from a register 14 a coded signal that indicates the character to be printed. When the number of pulses received from the photo-detector 10 since the last printing corresponds to the coded signal from the register 14, the comparator 13 responds to this coincidence and sends a signal on output line 15 to stop the motor 5.

The comparator 13 also responds to the difference between the position given by the signal from the register 14 and the position actually occupied by the disc 1. Therefore, the comparator furnishes on one or the other of the output lines 16 and 17 signals for causing the motor 5 to turn in one or the other direction, so as to bring the desired type character into position for printing. The means that enable the comparator to determine whether the desired position of the disc 1 is more quickly arrived at by a rotation in the one direction or the other are known and therefore will not be described in detail. The three output lines 15, 16 and 17 of the comparator 13 control a circuit 18, which, in turn, controls the motor 5.

The signal on the output line 15 is applied not only to the circuit 18 but also to an AND gate 20, the other input of which is connected to the output of the trigger 11. Thus, when the motor is stopped while a pulse is delivered by the trigger 11, the gate 20 furnishes an electric signal that operates the hamer 8 by means of a monostable multivibrator 19 and an amplifier 21.

As shown in FIG. 3, the amplifier 21 has an input 22 that controls the amplification factor of the amplifier, this input being directly connected to the output of the photo-detector 10. This arrangement enables the force driving the hammer 8 to be varied as a function of the amplitude of the signal furnished by the photo-detector 10, as will be seen in FIGS. 4A and 4B. In this way, it is possible to adapt the force with which the hammer strikes an arm 2 to the surface of the type character that is to be printed. It is quite obvious that the force used to print the character "." should be less than that used to a print a "W". Accordingly, the force with which an arm is struck (a printing characteristic) is controlled by information related to the surface area of the character to be printed. As shown in FIGS. 4A and 4B, this can be done by replacing the round apertures 4 of FIG. 1 with slits 24, 24' the radial lengths of which correspond to the size of the type character surface. FIG. 4B also shows that an arm 2 is wider for a character such as "M" than it is for a narrow character such as "I" and that the slit 24' is longer than the slit 24, resulting in a greater hammer force. This enables the diameter of the disc 1 to be rounded to a minimum and thus to limit the disc's inertia, thereby permitting very fast accelerations and decelerations and consequent high printing speeds.

The apertures 4 and 24, 24' can be simple openings, openings covered with a light passing material, or light passing inserts in the arms 2.

If it is desired to print with the spacing varied (variable printing step: another printing characteristic) as a function of the length of each character printed, the invention can incorporate some means that indicate, for example, the width of each type character. The indication can be obtained, for example, from the width of the arm incorporating the respective character, with an optical reader detecting the arm width and providing an electrical signal that determines the amplitude of the spring step (the amount of relative movement between the disc 1 and the surface printed on) for the character to be printed.

In accordance with the invention, this indication can also be obtained by use of apertures in the arms 2 in the same way as for controlling the printing force.

There are several possible embodiments for ensuring an exact positioning of a type character for printing, as well as for varying the printing force in dependence on the size of the type character surface and/or for printing with spacing varied in dependence on type character length. One such embodiment is shown in FIG. 5.

With reference to FIG. 5, there is provided at the free end of each arm 2 at least one projecting stop 25, the height of which varies in dependence on the desired printing force for the type character of the arm. The stop 25 cooperates with a member 26 that is free to move towards and away from the center of the disc 1. This member incorporates at least one V-shaped notch 27, which, when it engages the stop 25, acts to lock the disc 1 in the desired printing position. The downward movement required of the member 26 to lock is a function of the height of the stop 25; the amplitude of this movement provides a signal that enables control of the printing force.

In the embodiment shown in FIG. 5, the size or the position of the notch 27 or the size or the position of the stop 25 or any combination of size and position of the notch and/or the stop can be used to indicate either one or both printing characteristics.

FIG. 6 shows another embodiment for ensuring the correct printing position of the disc 1. Each arm 2 has a ferromagnetic member 28, and the printer comprises a magnetic pickup (not shown) positioned alongside the circular path through which the members 28 move.

In accordance with the invention, it may be required to furnish the disc 1 only with means for indicating the exact position at which the disc must be stopped to print a character or there can also be provided means for indicating the two aforesaid printing characteristics: namely, the desired printing force and/or the printing step as varied in dependence on the width of the type character to be printed.

It will be apparent to those skilled in the field of the invention that the means for indicating the width or surface area of each type character need not be incorporated on the disc 1; instead, they can very well consist of one or more independent members, such as one or more cams that are rotationally rigid with the disc 1 and constitute with the latter the rotatable support.

Although the invention has been described and particularly shown with reference to the preferred embodiment, those skilled in the art will understand that the invention admits of changes in form and detail, aside-from those already described, without exceeding the scope and spirit thereof.

I claim:

1. In a disc printer having a type character supporting disc rotatably mounted about an axis, type character supporting arms on said disc and extending radially about said disc and having type character supporting portions at their outer ends supporting type characters in relief, said characters having widths and sizes ranging from small to large, the outer ends of all of said character supporting portions being equally spaced apart around the entire disc, said character supporting portions being of varying widths, said widths being proportional to the widths of the type characters, whereby the size and inertia of the disc are reduced to a minimum, and hammer means for striking individual ones of said type characters against a printing surface for printing, indicating means associated with said support disc for indicating the angular printing position of each said type character, and reading means for reading said indicating means and for providing therefrom a signal to said hammer means for controlling the printing of each character so as to obtain a uniform distribution of the printed characters on the printed copy, said indicating means associated with each said type character and comprising means for indicating at least one printing characteristic of the associated said type character for causing printing that is dependent on said printing characteristic, said printing characteristic being the force, dependent on the area of each type character, with which said hammer means are to strike a respective said type character, said indicating means comprising an indicating structure formed on each arm, each indicating structure having a predetermined size responsive to said reading means which said reading means senses to thereby send signals to control the corresponding hammer force provided by said hammer means.

2. The improvement as defined in claim 1, wherein said indicating structure comprises an opening formed in each supporting arm, each opening having a predetermined size responsive to said reading means whereby a predetermined corresponding hammer force is provided.

3. The improvement as defined in claim 1, further including locking means for holding said support in a printing position for each of said type characters, said locking means comprising at least one depression, each said indicating means comprising at least one projecting stop means for cooperating with said depression in the printing position of the associated said type character.

4. The improvement as defined in claim 3, wherein the size of each said projecting stop means indicates a printing characteristic of the associated said type character, and further wherein said locking means are movable for enabling said depression thereof to engage said projecting stop means in the printing position of the associated said type character, the amplitude of this movement being dependent on the size of each said projecting stop means, whereby the amplitude corresponds to a printing characteristic of the associated said type character.

5. The improvement as defined in claim 3, wherein the position of each said projecting stop means indicates a printing characteristic of the associated and type character.

6. The improvement as defined in claim 5, wherein the size of each said projecting stop means also indicates said printing characteristic.

7. The improvement as defined in claim 3, wherein the position of said depression with respect to each said projecting stop means when the type character associated therewith is in the printing position is dependent on a printing characteristic of said type character.

8. The improvement as defined in claim 3, wherein the size of said depression in cooperation with each said projecting stop means indicates a printing characteristic of the type character associated with each said projecting stop means.

9. The improvement as defined in claim 8, wherein the position of said depression also indicates said printing characteristic.

10. The improvement as defined in claim 1, wherein said printing characteristic is the printing step, as dependent on the width of each said type character, from one printed character to the next.

11. The improvement as defined in claim 2, wherein each said means for indicating at least one printing characteristic comprise light passing means occupying a determined angular position with respect to the associated said type character, and said reading means include at least one photoelectric detector aligned with each of said light passing means in a respective rotational position of said support.

12. The improvement as defined in claim 11, further including at least one light source positioned to illuminate said photoelectric detector through said light passing means when the latter is positioned between said light source and said photoelectric detector.

13. The improvement as defined in claim 11, wherein each said light passing means is a slit (24) extending along a respective radial line passing through the axis of rotation of said support, the length of each said slit being a function of the surface area of the associated said type character.

* * * * *